US005120143A

United States Patent [19]

Fujiwara et al.

[11] Patent Number: 5,120,143

[45] Date of Patent: Jun. 9, 1992

[54] SOLENOID ENERGIZATION CURRENT CONTROLLING APPARATUS

[75] Inventors: Takashi Fujiwara, Okazaki; Masayuki Matsubayashi, Nagoya, both of Japan

[73] Assignee: Brother Kogyo Kabushiki Kaisha, Aichi, Japan

[21] Appl. No.: 554,019

[22] Filed: Jul. 17, 1990

[30] Foreign Application Priority Data

Jul. 18, 1989 [JP] Japan ..... 1-185050

[51] Int. Cl.[5] ..... B41J 9/38; B41J 9/50

[52] U.S. Cl. ..... 400/157.2; 101/93.29; 361/153

[58] Field of Search ..... 400/157.2, 157.3, 166; 101/93.29; 361/152-154, 182, 184

[56] References Cited

U.S. PATENT DOCUMENTS

| | | | |
|---|---|---|---|
| 3,909,681 | 9/1975 | Campari et al. | 400/157.2 |
| 4,262,592 | 4/1981 | Araki | 400/157.3 |
| 4,546,403 | 10/1983 | Nielsen | 361/152 |
| 4,605,983 | 8/1986 | Harvey | 361/154 |
| 4,667,117 | 5/1987 | Nebgen | 400/157.3 |
| 4,823,825 | 4/1989 | Büchl | 361/152 |
| 4,922,878 | 5/1990 | Shinogle | 361/154 |

FOREIGN PATENT DOCUMENTS

| | | | |
|---|---|---|---|
| 0067937 | 12/1982 | European Pat. Off. | 400/157.2 |
| 0263949 | 4/1988 | European Pat. Off. | 400/157.2 |
| 99667 | 6/1985 | Japan | 400/157.2 |
| 61-263776 | 11/1986 | Japan | 400/157.2 |
| 58561 | 3/1989 | Japan | 400/157.2 |

OTHER PUBLICATIONS

Communication dated Nov. 14, 1990, European Search Report EP 90307821.0.

Annex to the European Search Report Abstract.

*Primary Examiner*—David A. Wiecking

*Assistant Examiner*—Steven S. Kelley

*Attorney, Agent, or Firm*—Kane, Dalsimer, Sullivan, Kurucz, Levy, Eisele and Richard

[57] ABSTRACT

In a printing device employing a solenoid for driving a printing hammer, provided are switching member for ON/OFF operating electric current flowing through the solenoid coil, voltage generating member for generating voltage in accordance with the electric current, converting member for converting the generated voltage to a digital value, chopping member for comparing the converted digital value with a predetermined comparison value, while for turning on the switching member when the converted value is smaller than the predetermined comparison value and turning off the switching member when the converted value is larger than the predetermined comparison value, another chopping member for alternatively turning the switching member in another predetermined interval shorter than the predetermined interval, when the set value becomes similar to the comparison value, during said predetermined interval. Thus, the current deviation at each of the solenoid driving period are controlled to be limited in the desired range.

11 Claims, 10 Drawing Sheets

SOLENOID ENERGIZATION CURRENT CONTROLLING APPARATUS

BACKGROUND OF THE INVENTION

The present invention relates to a controlling apparatus of a solenoid used for driving a printing section of a printing unit (for example, a printing hammer, a wire, and the like for striking a printing element wheel), more particularly to a controlling apparatus of a solenoid for controlling electric current which flows through the solenoid in each of solenoid driving periods so as to be uniformalized even though the voltage of a drive source for driving the solenoid is unstable. This type of controlling apparatus, proposed by the same assignee in for example Japanese Provisional Publication SHO 61-263776, has been known.

FIG. 1A shows an outline of a printing mechanism of a typewriter to which the present invention is to be applied. A carriage 102 is reciprocally moved along a platen 100. The carriage 102 holds a daisy shaped printing element wheel 104 with a large number of printing elements on the peripheral position thereof. The printing element wheel 104 is connected to a printing element selection motor 100. Behind the printing element wheel 104, a printing hammer unit 108 is supported by the carriage 102. A hammer 110 of the printing hammer unit 108 is advanced and a selected printing element of the printing element wheel 104 is struck via a printing ribbon 114 from the backside of the printing element wheel 104 to a sheet 112 held by the platen 100 and thereby the desired letter is printed on the sheet 112.

The hammer 110 is driven by a solenoid 110 shown in FIG. 2. The solenoid 116 is fixed in a housing 118 of the printing hammer unit 108. Inside the housing 118, the hammer 110 is movably held by guide members 120 and 122. The hammer 110 is tensioned to the retreat position by an elastic spring 124. However, when the solenoid 116 is powered the hammer 110 advances against the tension force of the spring 124 and strikes the rear surface of the desired printing element of the printing element wheel 104 as described above. It is preferred by controlling the solenoid current to keep it constant while the hammer 110 is struck so as to make stable the impact force caused by the hammer 110. An outline of a typical control circuit for that is shown in FIG. 3.

A power supply to the solenoid 116 is turned on and off by a switching circuit 126. The solenoid current is converted into voltage value by a resister 128 for detecting the current. The resultant voltage is converted into a digital value, hereinafter named the A/D (Analog/Digital) conversion value, by an A/D converter 130 and a reference voltage generating circuit 132. The A/D conversion value is output to a controlling circuit 134. In this example, the A/D converter 130, the reference voltage generating circuit 132, and the controlling circuit 134 are included in a CPU (Central Processing Unit) 134-1. The control circuit 134 of the CPU 134-1 executes a so-called chopping control operation where it compares a digital value, i.e., the A/D conversion value, with a predetermined comparison value and turns on the switching circuit 126 when the digital value is smaller than the comparison value, while the control circuit 134 turns off the switching circuit 126 when the digital value is greater than the comparison value. Thus, the solenoid current becomes a saw shape, as shown in FIG. 4, in one printing cycle, hereinafter named a solenoid drive time period, so that the current becomes stable in accordance with the comparison value.

However, in the above solenoid control operation, since the timings of ON/OFF operations of the current flowed through the solenoid 116 depend on the processing speed of the A/D converter 130. When the processing speed of the A/D converter is low, for example, when it is incorporated in the CPU as shown in FIG. 3, the current deviation indicated as "ΔI" in FIG. 4 becomes large. Especially, if the solenoid drive voltage is unstable, the variation of the current deviation "ΔI" at each of solenoid driving periods becomes large, thereby the print impact force undesirably varies and then the printing quality degrades. On the other hand, when another A/D converter whose processing speed is high is used, for example, when the dedicated IC (Integrated Circuit) for the A/D converter is used, the current control circuit becomes very expensive although the above problem can be solved.

SUMMARY OF THE INVENTION

It is therefore an object of the invention to provide an improved solenoid controlling apparatus for supplying as stable a solenoid current as possible even if the solenoid drive voltage is not stable.

For this purpose, according to the present invention, there is provided a solenoid controlling apparatus, for controlling electric current flowing through said solenoid, comprising switching means for ON/OFF operating the electric current, said solenoid controlling apparatus further comprising:

value setting means for setting a digital value in accordance with the electric current;

chopping means for comparing the set value with a predetermined comparison value in a predetermined interval, while for turning on said switching means when the set value is smaller than the predetermined comparison value and turning off the switching means when the set value is larger than the predetermined comparison value at each of the comparing operation; and another chopping means for alternatively turning said switching means in another predetermined interval shorter than said predetermined interval during said predetermined interval when said set value becomes similar to said predetermined comparison value.

DESCRIPTION OF THE ACCOMPANYING DRAWINGS

FIG. 8 is a diagram showing solenoid driving current characteristic wherein the variation of the current deviation at each of the solenoid driving periods is uniformalized in accordance with the controlling operation of the present invention.

DESCRIPTION OF THE EMBODIMENTS

Referring to the accompanying drawings, an embodiment will be described hereinafter.

Figure 1A:
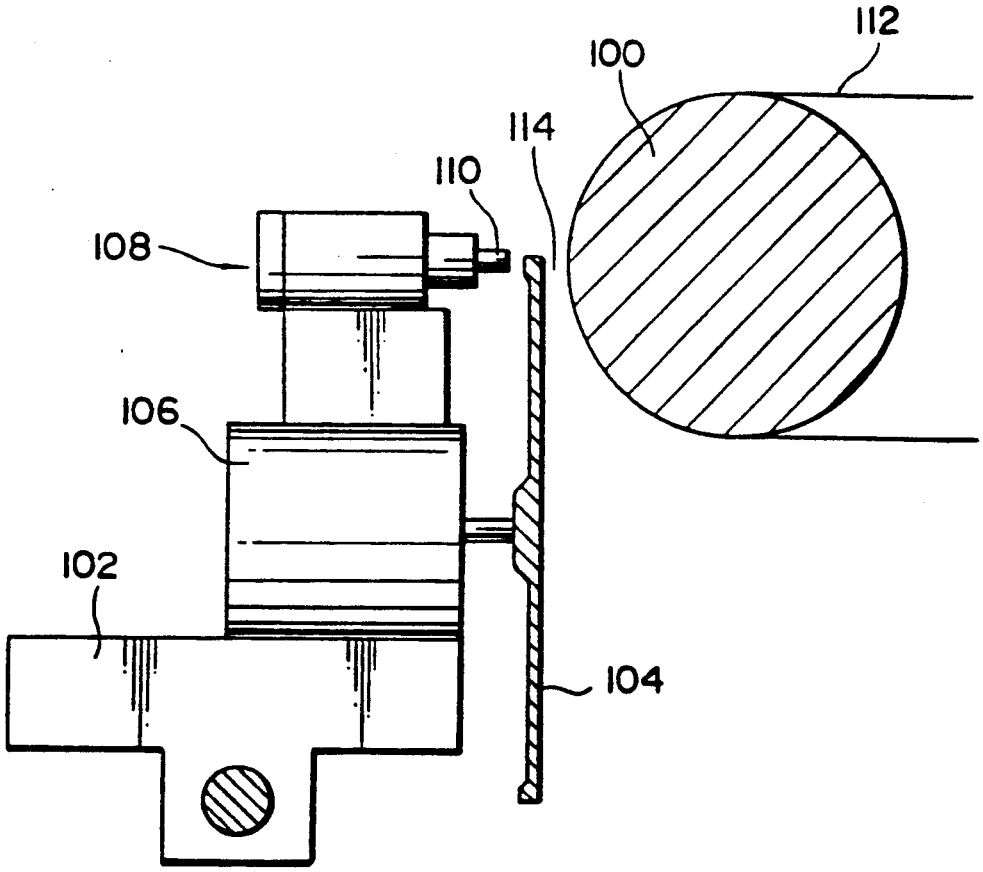
FIG. 1A is a sectional view showing an outline of a printing section of a printing device to be controlled by the solenoid controlling apparatus according to the present invention.

In this embodiment, the printing hammer unit 108 for a daisy shaped printing element wheel type typewriter shown in FIG. 1A is used. The hammer drive solenoid 116 is controlled.

Figure 1B:
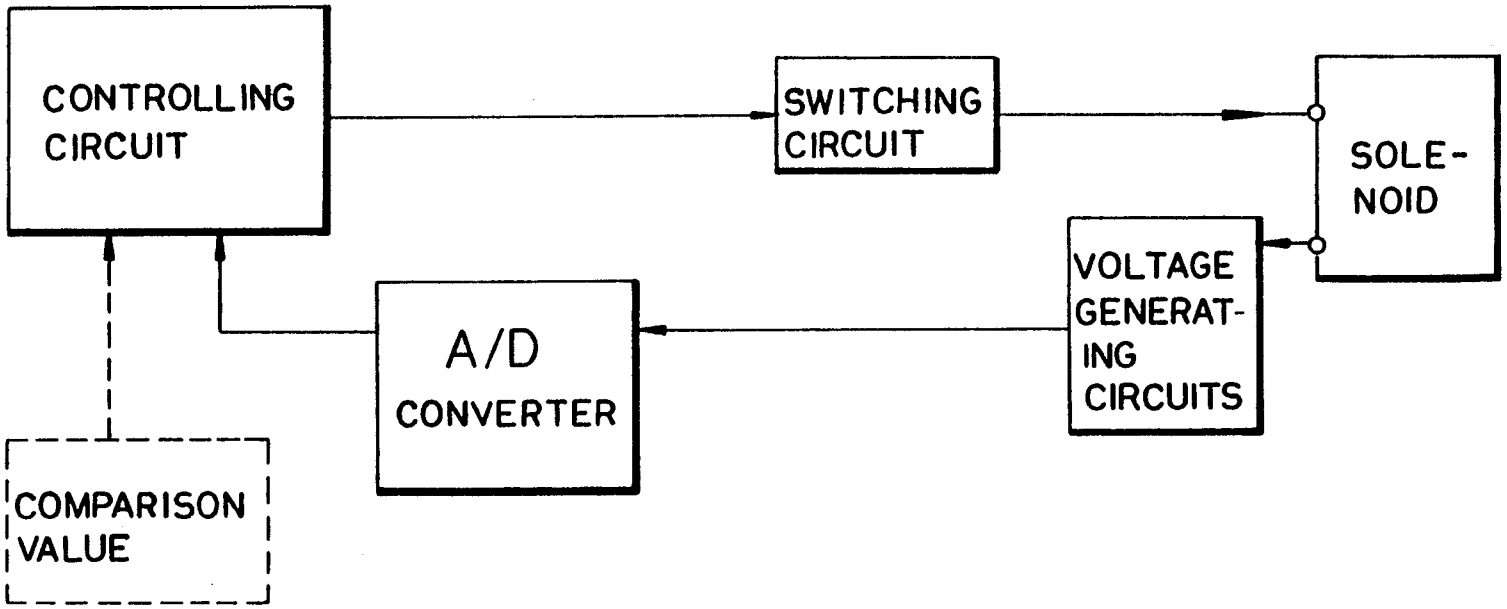
FIG. 1B is a block diagram of a controlling system for controlling the printing section of FIG. 1A.

FIG. 1B is a block diagram of a control system according to the present invention for controlling the printing section shown in FIG. 1A. An electric current flowing through the solenoid is controlled to be ON/-OFF operated by means of switching circuit, so that the electric current is uniformalized during a predetermined period, and then, the printing quality is uniformalized. The electric current is controlled as follows. First, the voltage proportional to the electric current is generated at the voltage generating circuit. The voltage is converted into the corresponding digital value by means of the A/D converter further the converted digital value is compared with a predetermined comparison value having been determined in advance. The switching circuit is controlled by the controlling circuit so as to ON/OFF operate the electric current flowing through the solenoid in accordance with a result of the above comparing operation. In other words, the electric current is OFF operated in case that the generated voltage is smaller than a predetermined value. On the other hand it is ON operated in case that the generated voltage is larger than the predetermined value, therefore, the electric current flowing through the solenoid is uniformalized.

Figure 5A:
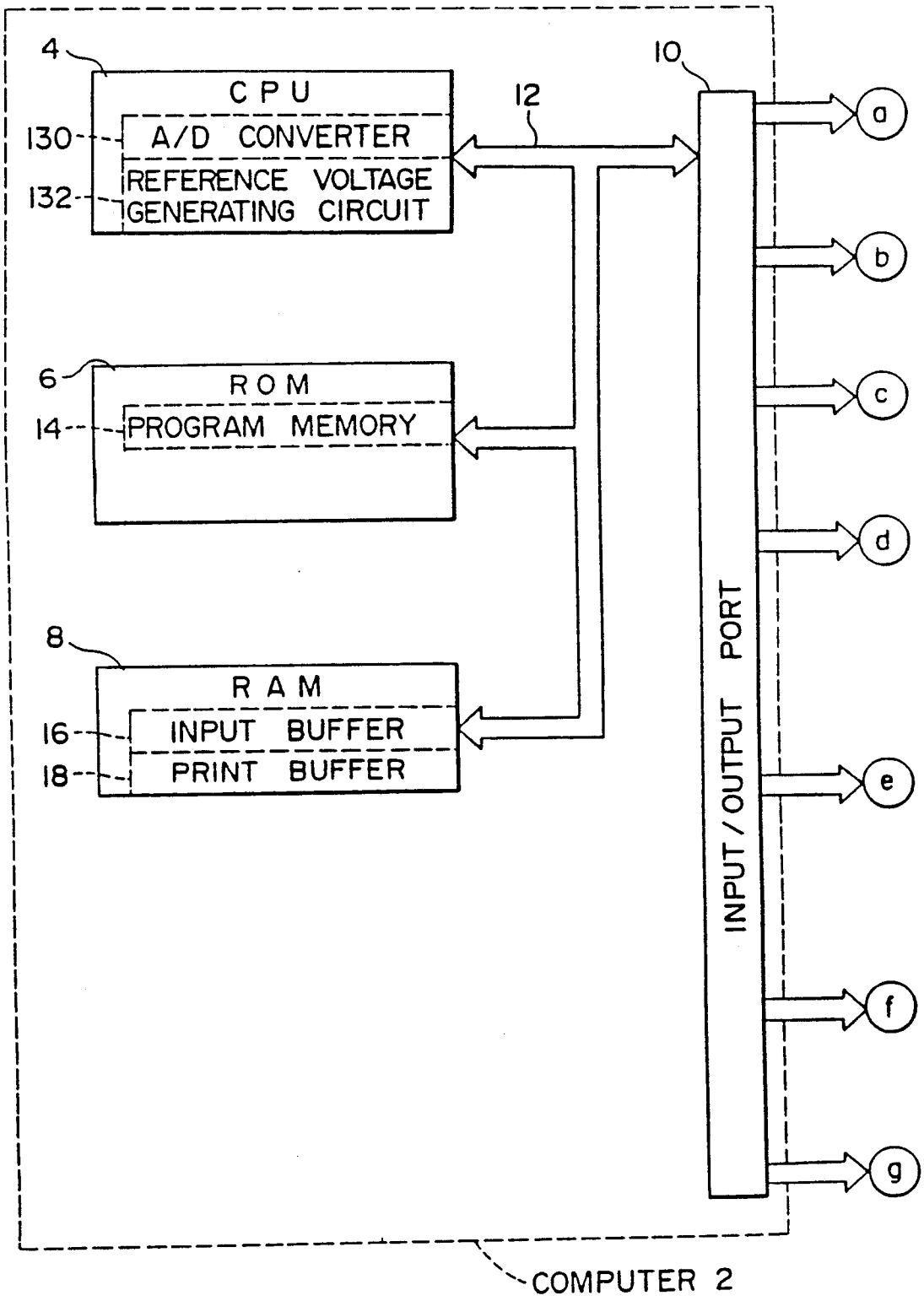
FIGS. 5A and 5B are block diagrams of the entire control section of the printing device including the solenoid controlling apparatus embodying the present invention.
Figure 5B:
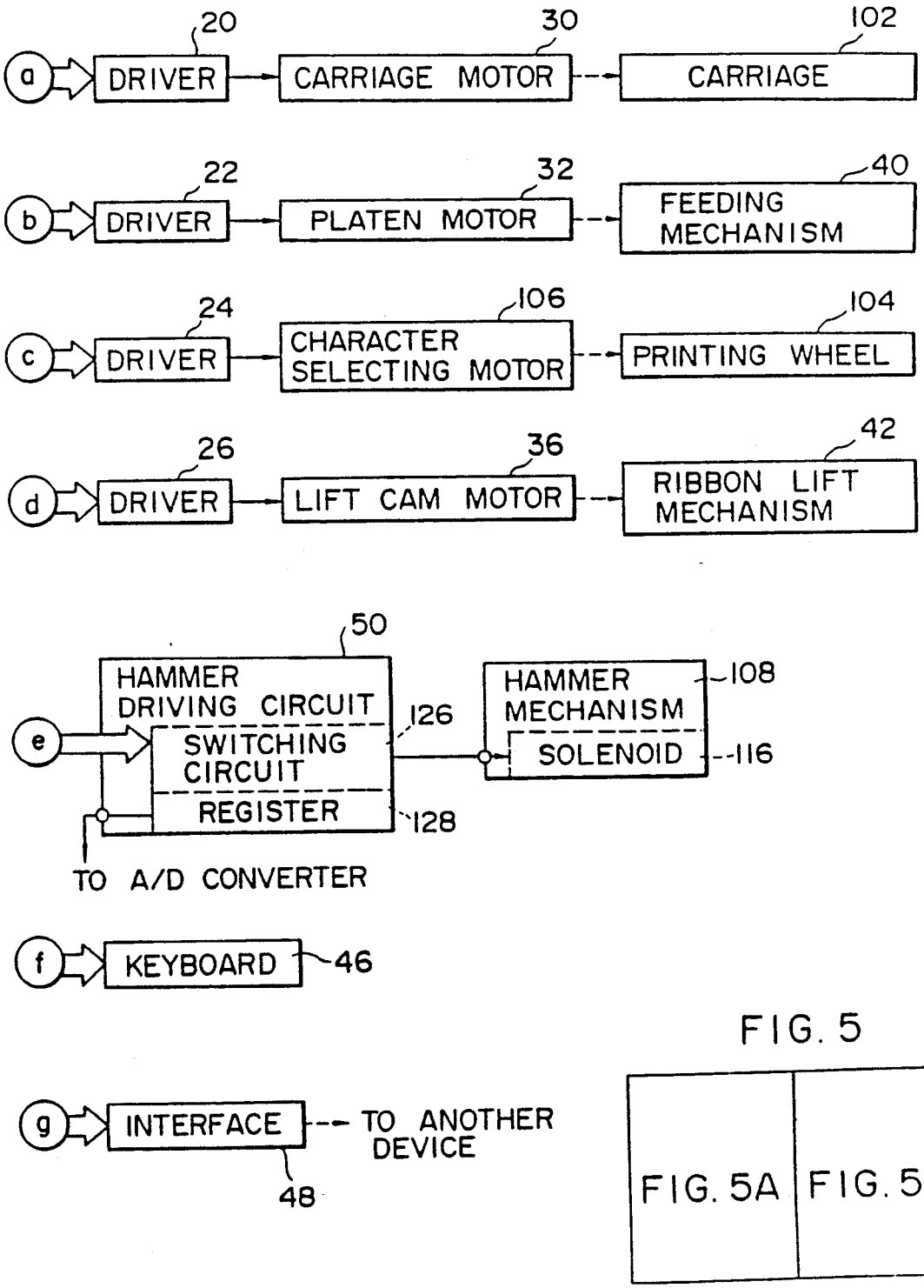
Figure 5:
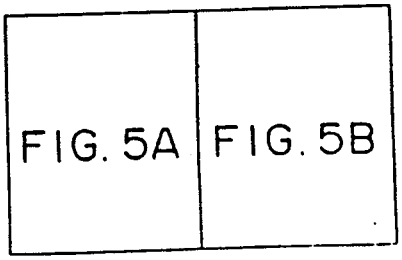

FIG. 5 is a block diagram showing the entire control operations of the typewriter including the printing section shown in FIG. 1A. The principal section of the drawing is a computer 2. The computer 2 is provided with a CPU (Central Processing Unit) 4 for executing various computation control operations necessary for the typewriter operations, a ROM (Read Only Memory) 6 for storing program data and various constants, a RAM (Random Access Memory) 8 for reading and writing data therefrom and thereto, and an I/O (Input-/Output) port 10 including a plurality of ports, for receiving and/or transmitting the data, each of ports are respectively connected to a bus line 12.

The CPU 4 is provided with the A/D converter 130 for converting an analog input signal to a digital signal and the reference voltage generating circuit 132 for generating reference voltage to be compared with the converted signal necessary for the A/D conversion. In a program memory 14 of the ROM 8, besides a solenoid control program described later, other programs necessary for the entire process of the typewriter are stored.

The RAM 8 serves as working areas of an input buffer 10, a print buffer 18, and so on.

As well known, the I/0 port 10 is connected to various motors 30, 32, 106, and 36 via drivers 20, 22, 24, and 26. These motors respectively drive each of the carriage 102, a sheet feed mechanism 40 including the platen 100, the printing element wheel 104, and a known ribbon lift mechanism 42. In addition, the I/O port 10 is connected to a keyboard 46 and to an interface 48 for connecting the apparatus to another external device.

Figure 6:
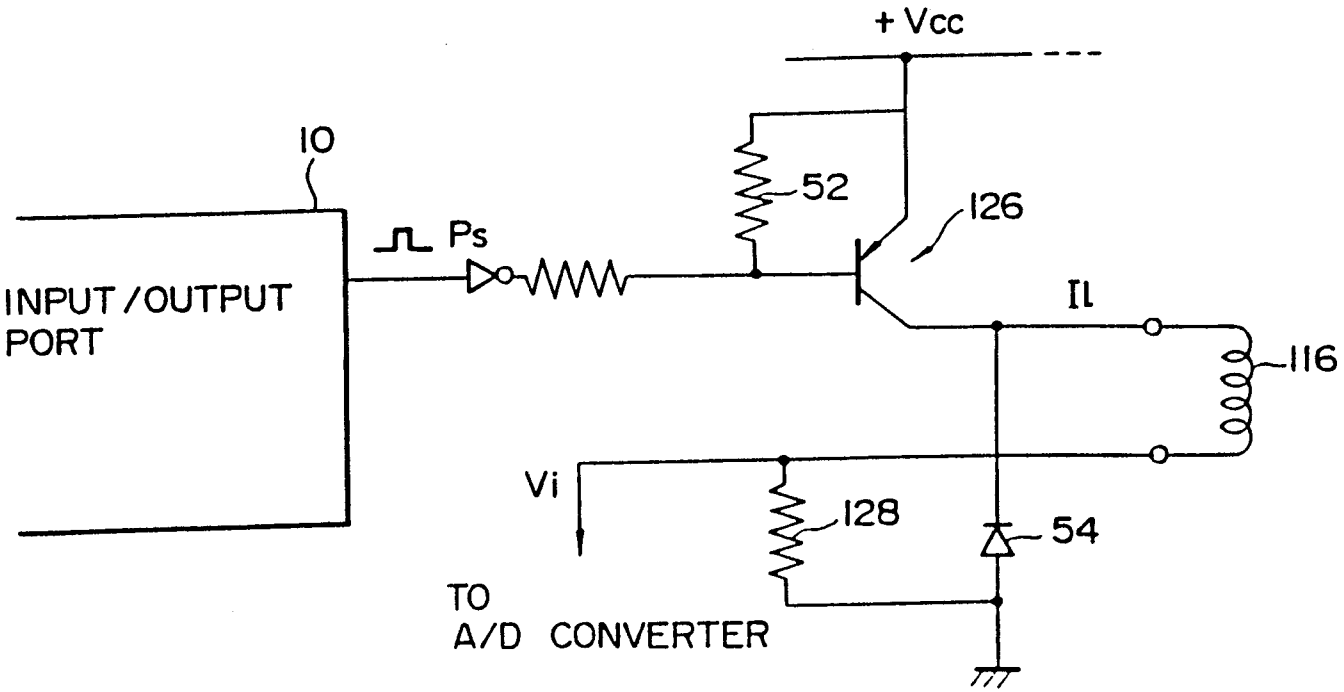
FIG. 6 is a schematic of a hammer drive circuit of FIG. 5.

In addition, the printing hammer unit 108 is also connected to the I/O port 10 via a hammer driving circuit 50. The hammer driving circuit 50 is provided with a switching circuit 126 for turning on and off the current to the solenoid 116 of the printing hammer unit 108, and a resister 128 for detecting a voltage which is converted from the current which flows through the solenoid 116. This section is shown in detail in FIG. 6.

The switching circuit 126 is provided with a transistor 52 as a switching element the transistor 52 being turned on or off according to a pulse control signal "Ps" which is output from the I/O port 10 so as to control the current which flows through the solenoid 116 of the printing hammer unit 108. The resister 128 is connected serially to the solenoid 116, the voltage according to the solenoid current being input to the reference voltage circuit 132. The collector of the transistor 52 is connected to a flywheel diode 54 for protecting a reverse current flowing thereto.

Figure 7:
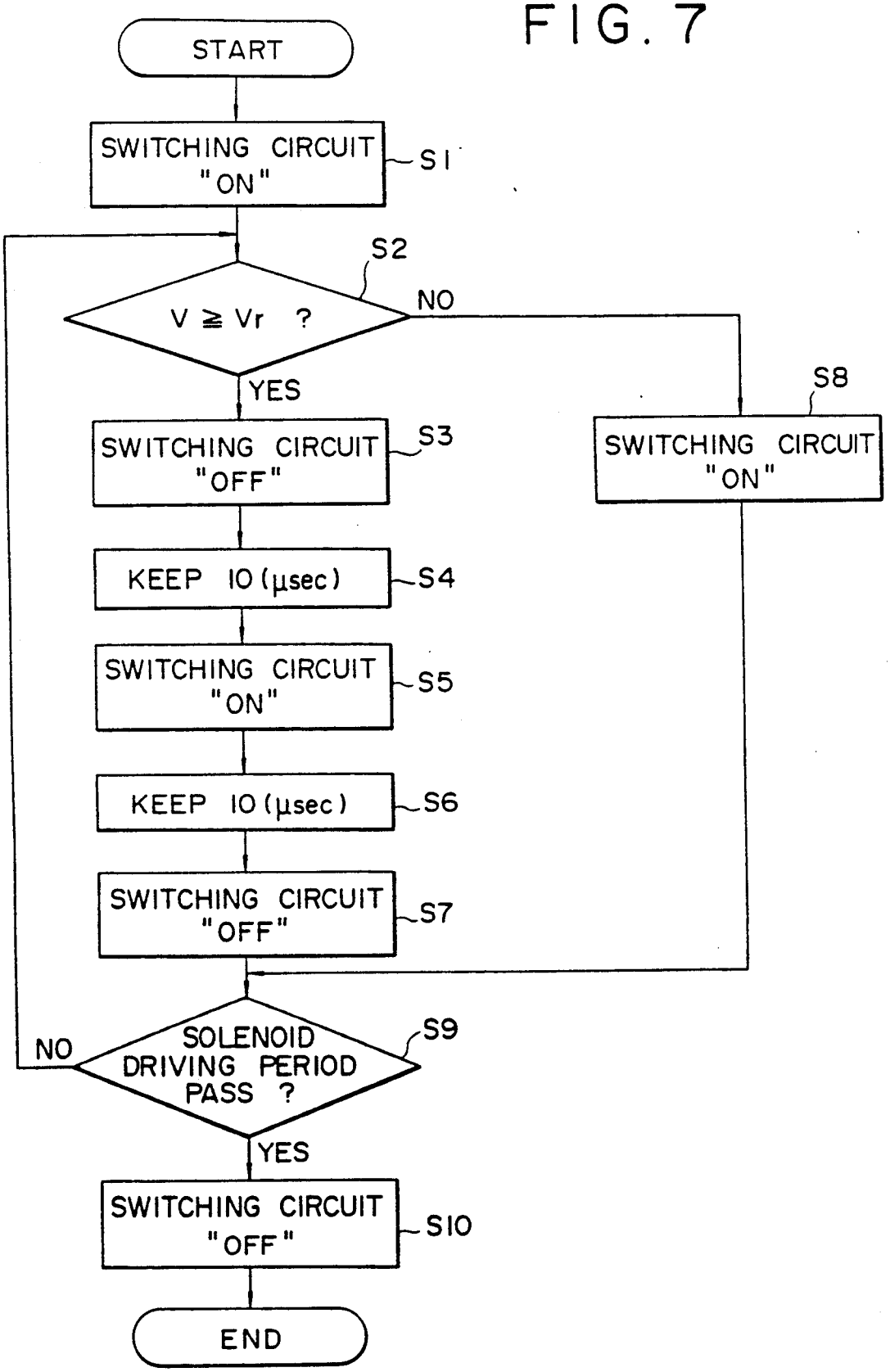
FIG. 7 is a flowchart of the controlling operation executed by the solenoid controlling apparatus according to the present invention.

A program which is stored in the program memory 14 of the ROM 6 and closely relate to the solenoid drive control operation according to the present invention will be described hereinafter by referring to a flowchart of FIG. 7.

Figure 2:
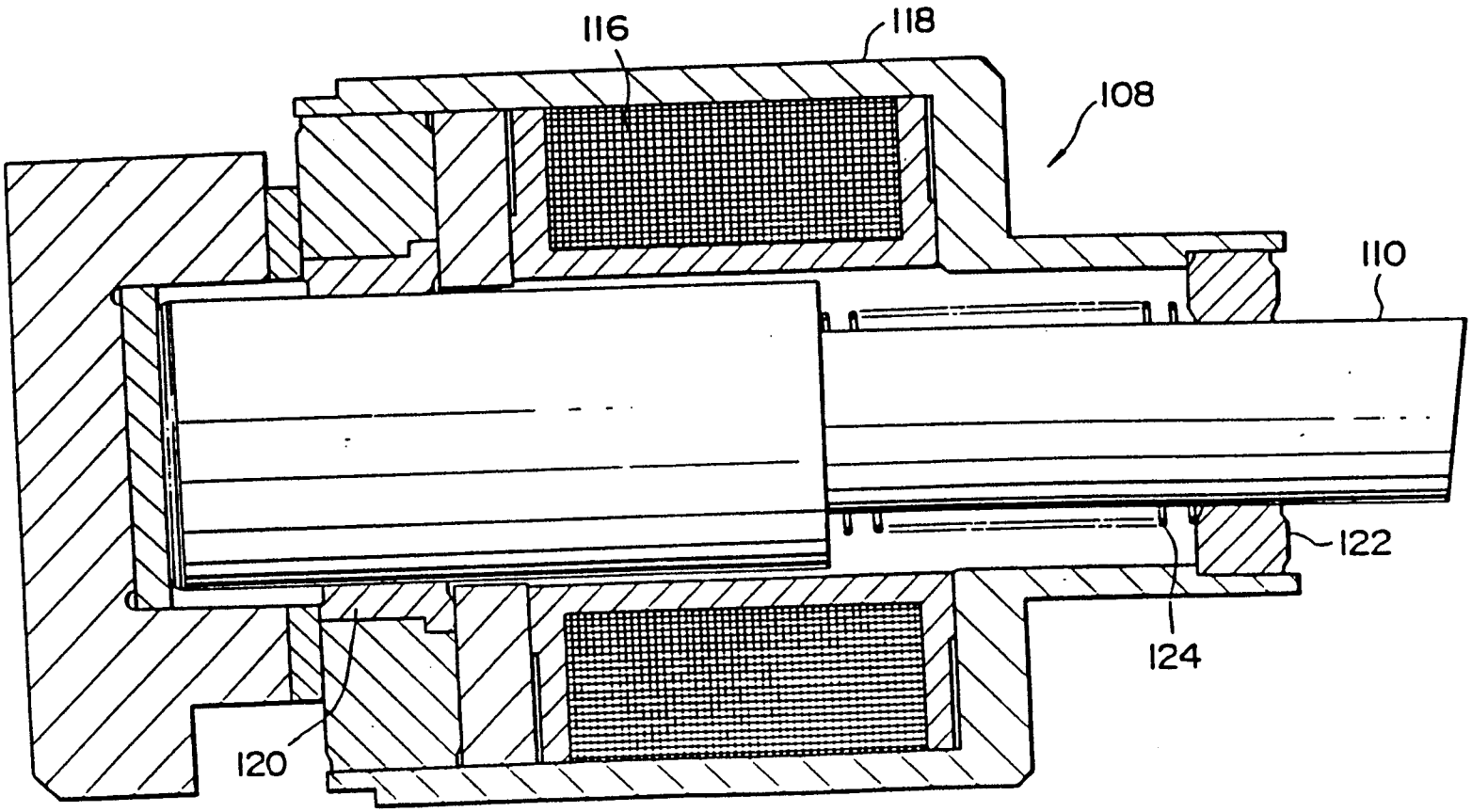
FIG. 2 is a sectionally enlarged view of the printing hammer unit incorporated in the printing device of FIG. 1A.
Figure 3:
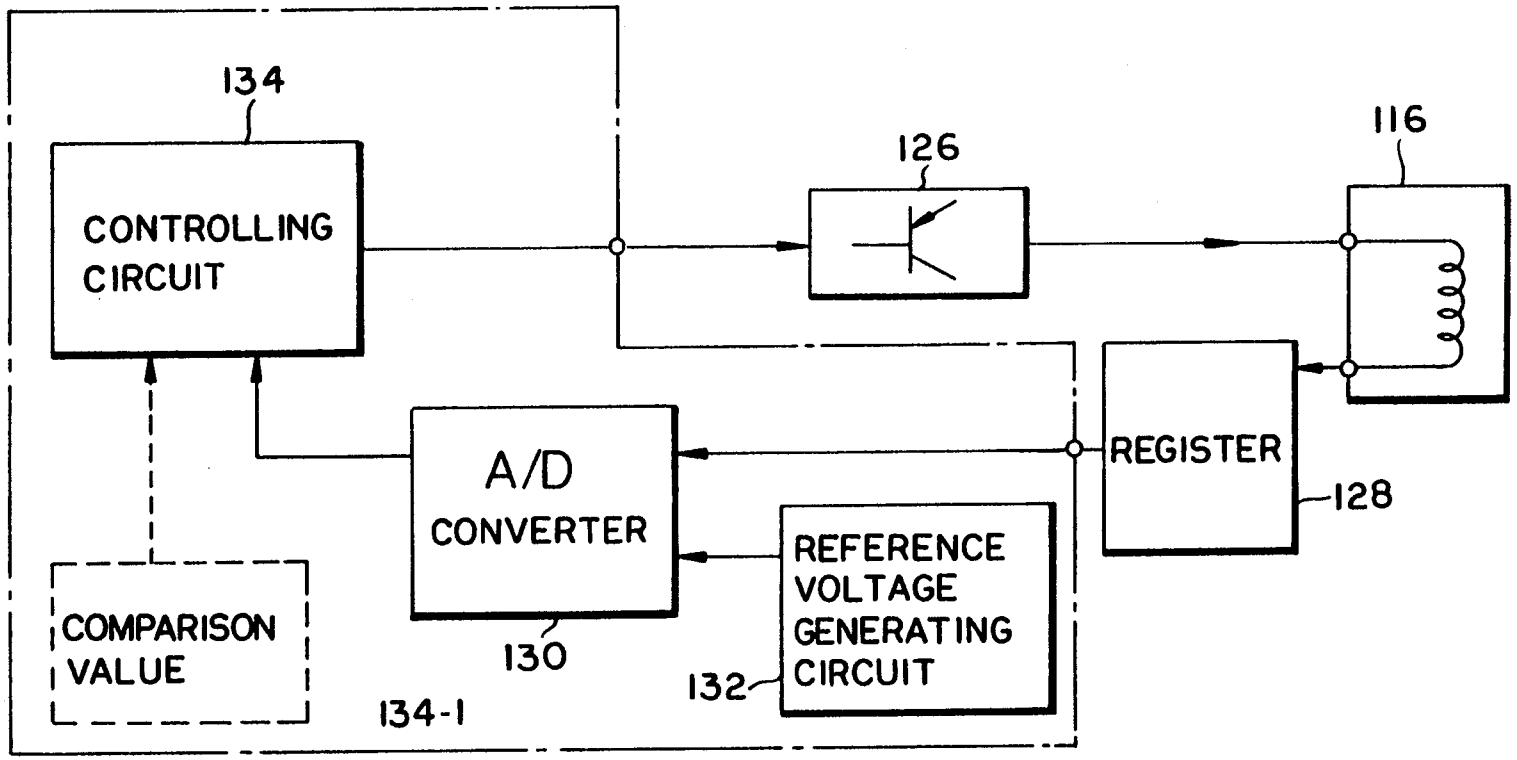
Figure 4:
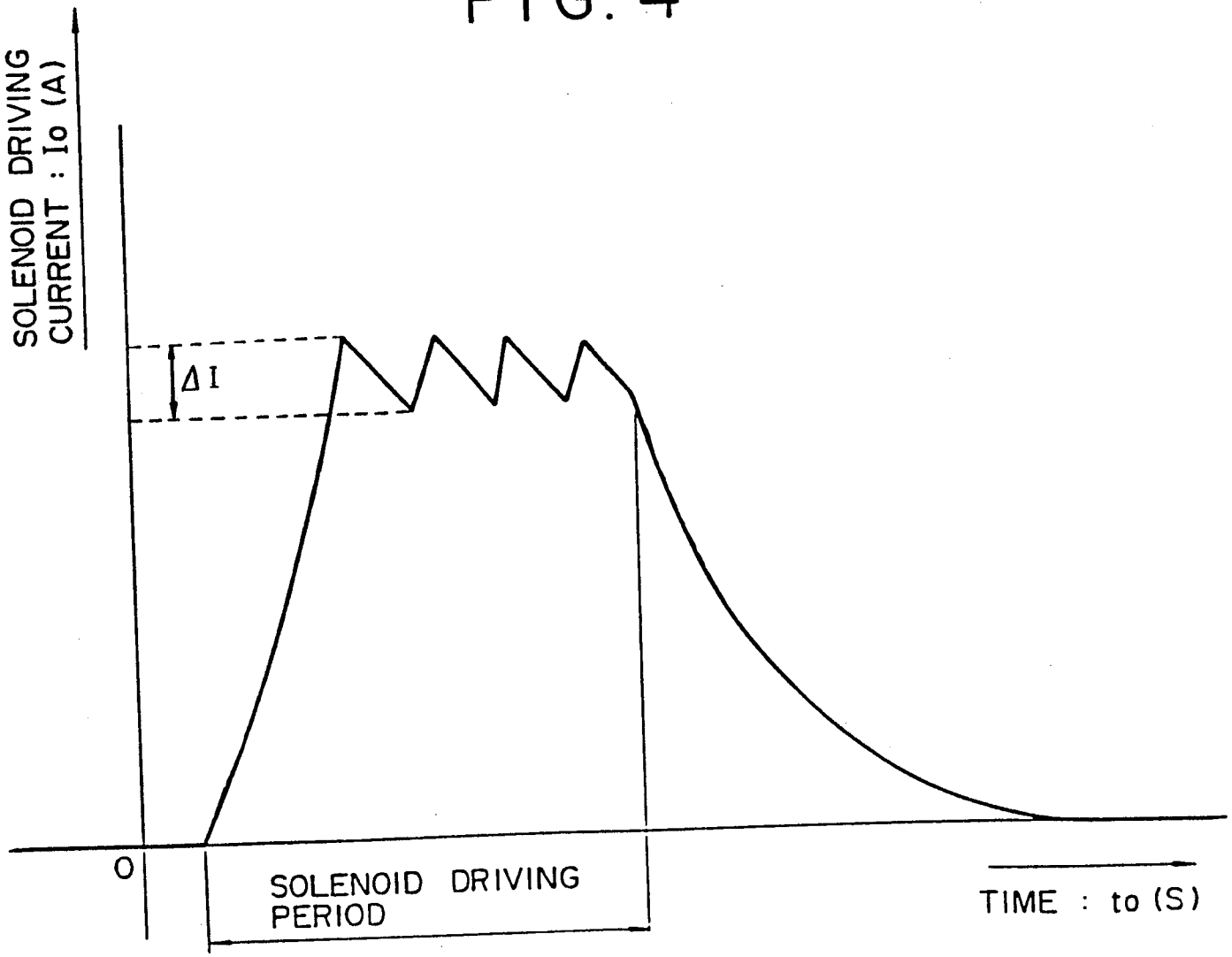
FIG. 4 is a diagram showing solenoid driving current characteristic during a solenoid controlling operation.

First, in step S1, when the switching circuit 126 is turned on for driving the hammer, the current is flowed through the solenoid 116 shown in FIG. 2. The solenoid current is converted into a voltage by the resister 128 and supplied to the CPU 4 via the I/O port 10. In other words, a voltage value proportional to the current is generated between the terminals of the resister 128, and then, the generated voltage is supplied to the CPU 4. The A/D converter 130 incorporated in the CPU 4 converts the voltage into a corresponding digital value "V". In step S2, the digital value "V", i.e., A/D conversion value, is compared with a comparison value "Vr" which has been stored in the ROM 6. When the digital value "V" is less than the comparison value "V", the current flowing through the solenoid 116 is kept. In step S9, it is determined whether the solenoid driving period per print operation, for example, 5(msec.), which has been stored in the ROM 6 is passed or not. When the time period did not elapse, the process is returned back to step S2 and the steps S2, S8, and S9 are repeated until the A/D conversion value "V" of the voltage according to the solenoid current becomes equal to the comparison value "Vr", that is, until the solenoid current becomes a predetermined level.

In step S2, when it is determined that the A/D conversion value "V" exceeds the comparison value "Vr", the process is advanced to step S3. In step S3, the switching circuit 126 is turned off and the current having been flowed through the solenoid 116 is stopped. In step S4 this off state is kept for 0.01(msec.), for example. The 0.01(msec.) is very short time period when compared with the processing time period of the A/D converter 130, for example, 0.06(msec.) When 0.01(msec.) is passed in step S4, the switching circuit 126 is turned on in step S5 and the current is flowed through the solenoid 116 again. In step S6, the on state is kept for 0.01(msec.), thereafter, the switching circuit 126 is turned off again in step S7 and thereby the current having been flowed through the solenoid 116 is stopped. In other words, by the operation executed by the steps S3 through S7, the solenoid current is chopped in the order of the on state, off state, on state, and off state. The process is returned from S9 to S2 and then the steps S3 through S7 are executed until the A/D conversion value "V" according to the solenoid current becomes lower than the comparison value "Vr". In step S2, when it is determined that the A/D conversion value "V" is lower than the comparison value "Vr", the process is advanced to step S8. In step S8, the switching circuit 126 is turned on. The process is returned back to S2 and the chopping control operation including steps S3 through S9 is executed in until it is determined that the solenoid driving period, i.e., 5(msec.), is passed.

The control operation which passes through steps S2 through S7 is repeatedly executed several times during the control operation which passes through S2 to S8. When it is determined that the solenoid driving period, i.e., 5(msec.), has been passed in step S9, the switching circuit 126 is finally turned off in step S10 and thereby the hammer 110 is returned back to the retreat position by the spring 124 and the one print operation is completed.

Figure 8:
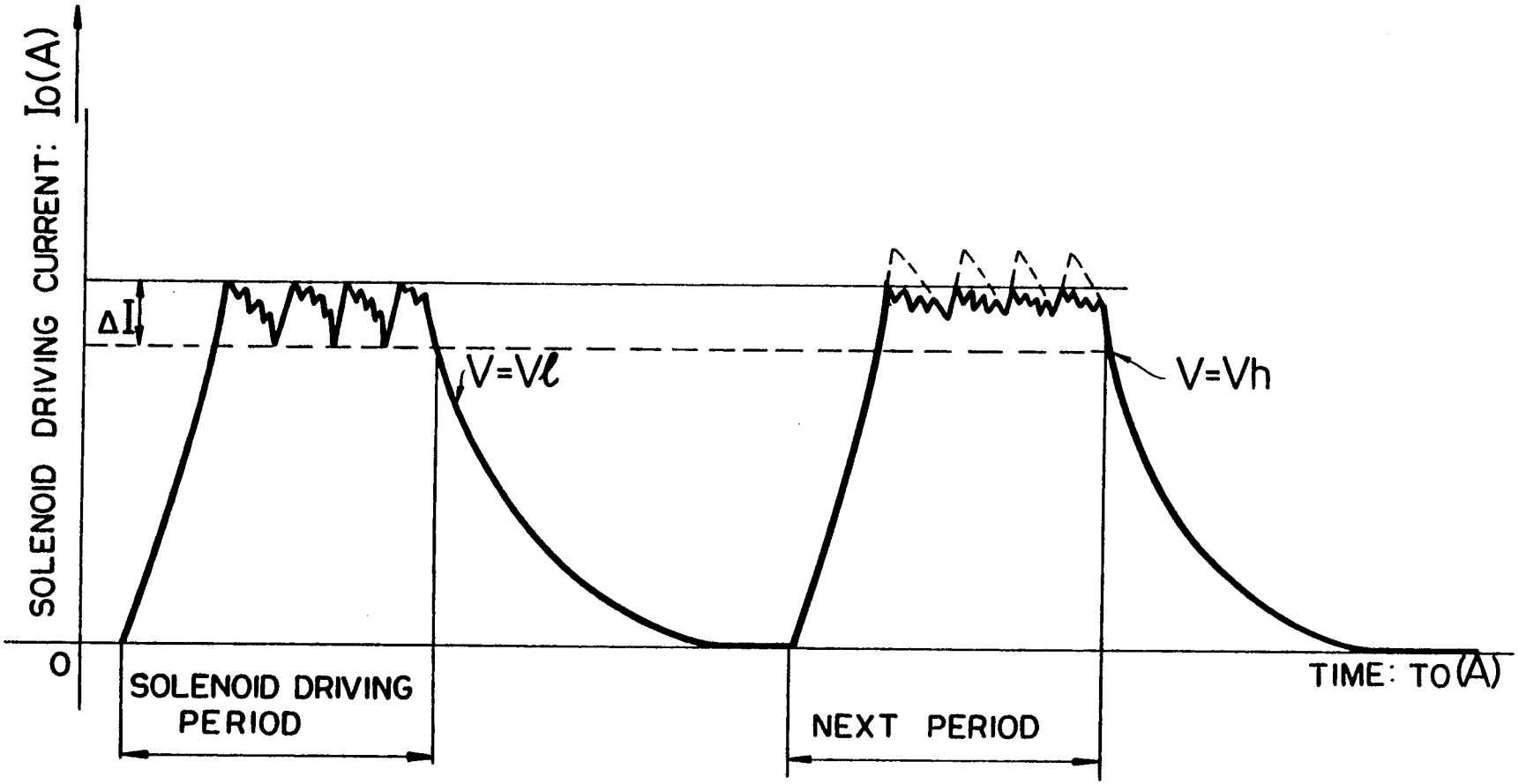
FIG. 8 is a circuit diagram showing the hardware control section of the solenoid of the printing hammer unit of FIG. 2.

By the control operation described above, the deviation of the driving current for the solenoid 116 is limited, as shown in FIG. 8, in a range defined by the current variation "ΔI" even though the voltage "Vo" of the drive source for driving the solenoid 116 is unstable. When the voltage "Vo" is low, i.e., V=Vl, the driving current flowed through the solenoid 116 is chopped in accordance with the A/D conversion period, as shown on the left of the drawing of FIG. 8. Since the A/D conversion value "V" is based upon the current flowed through the solenoid 116, the value "V" is proportional to the voltage "Vo". If the voltage "Vo" of the drive source is increasingly varied to "Vh" during the interval between the solenoid driving period because of the unstableness thereof, the current is controlled so as not to exceed a predetermined limitation, i.e., upper limitation of the current variation "ΔI" as shown on the right of the drawing of FIG. 8. In other words, the conventional solenoid control operation involves steps S1, S2, S3, S8, S9 and S10 shown in FIG. 7 except steps S4 through S7. Thus, the steps S1, S2, S3, S8, S9 and S10 relate to a chopping control operation every long time period i.e., the period according to the processing time of the A/D converter 130. On the other hand, in the present embodiment, a chopping control operation for a time period represented by steps S4 through S7 is added.

In the embodiment described above, the chopping operation for the short time period can be executed if the current flowing through the solenoid 116 reaches a predetermined limitation even though the drive source of the solenoid 116 is undesirably varied. In other words, the drive current of the solenoid 116 is controlled to be uniformalized at each of the solenoid driving period. Thus, even if the processing time of the A/D converter 130 is long and the voltage of the drive source for driving the solenoid 116 is unstable, the current deviation of the driving current can be decreased to a small value and thereby the printing quality can be further improved. In addition, in comparison with an A/D converter whose processing time is fast, the control system can be inexpensively structured.

In the embodiment described above, the chopping operations in the short period are executed at the fall state of the current. It may be considered that the control program is so structured as to execute the chopping operations at the rise state of the current or at the both states.

In addition it is apparent to those skilled in the art that various modifications may be made and other embodiments implemented without departing from the scope of the present invention.

What is claimed is:

1. A solenoid controlling apparatus, for controlling electric current flowing through said solenoid, comprising switching means for ON/OFF operating the electric current, said solenoid controlling apparatus further comprising:

value outputting means for outputting a digital value in accordance with the electric current;

chopping means for comparing the value outputted by said outputting means with a predetermined comparison value at a predetermined interval, and for turning on said switching means when said outputted value is smaller than said predetermined comparison value and turning off said switching means when said outputted value is larger than or equal to said predetermined comparison value at each of the comparing operations; and another chopping means responsive to said chopping means turning off said switching means for alternately turning ON and OFF said switching means at another predetermined interval shorter than said predetermined interval when said outputted value approaches said predetermined comparison value, during said predetermined interval.

2. The solenoid controlling apparatus according to claim 1, wherein said value outputting means comprises a voltage generating means for generating voltage in accordance with the electric current and converting means for converting the generated voltage to a corresponding digital value.

3. The solenoid controlling apparatus according to claim 2, wherein said voltage generating means comprises a resister element through which the current is flowed and wherein said converting means comprises an A/D converter, whereby the voltage proportional to the electric current is generated between the terminals of said resister element and the generated voltage is converted to a corresponding digital value.

4. The solenoid controlling apparatus according to claim 1, wherein said switching means comprises a transistor arranged to be ON operated when a trigger pulse is supplied to a base thereof and a trigger pulse generating member for supplying the trigger pulse to the base of said transistor when the outputted value is smaller than the predetermined comparison value.

5. The solenoid controlling apparatus according to claim 1, wherein said another chopping means is arranged to be operated when the outputted value is increasingly varied.

6. A printing device, for printing a character and/or symbol data on a predetermined printing medium by means of a printing hammer arranged to be driven by a solenoid, comprising:

switching means for ON/OFF operating electric current flowing through said solenoid;

value outputting means for outputting a digital value in accordance with the electric current;

chopping means for comparing the value outputted by said outputting means with a predetermined comparison value at a predetermined interval, and for turning on said switching means when said outputted value is smaller than said predetermined comparison value and turning off said switching means when said outputted value is larger than or equal to said predetermined comparison value at each of the comparing operations and;

another chopping means responsive to said chopping means turning off said switching means for alternately turning ON and OFF said switching means at another predetermined interval shorter than said predetermined interval, when said outputted value approaches said predetermined comparison value, during said predetermined interval.

7. The printing device according to claim 6, wherein said value outputting means comprises voltage generating means for generating voltage in accordance with the electric current and converting means for converting the generated voltage to a digital value.

8. The printing device according to claim 7, wherein said voltage generating means comprises a resister element through which the current is flowed and wherein said converting means comprises an A/D converter, whereby the voltage proportional to the electric current is generated between the terminals of said resister element and the generated voltage is converted to a corresponding digital value.

9. The printing device according to claim 6, wherein said switching means comprises a transistor arranged to be ON operated when a trigger pulse is supplied to a base thereof and a trigger pulse generating member for supplying the trigger pulse to the base of said transistor when the converted value is smaller than the predetermined comparison value.

10. The printing device according to claim 6, wherein said another chopping means is arranged to be operated when the outputted value is increasingly varied.

11. A current controlling system adapted to be positioned in a device including at least a power source for generating electric current flowing through a predetermined element provided on said device, comprising:

switching means for ON/OFF operating the electric current;

value outputting means for outputting a digital value in accordance with the electric current;

chopping means for comparing the value outputted by said outputting means with a predetermined comparison value at a predetermined interval, and for turning on said switching means when said outputted value is smaller than said predetermined comparison value and turning off said switching means when said outputted value is larger than or equal to said predetermined comparison value at each of the comparing operations; and another chopping means responsive to said chipping means turning off said switching means for alternately turning ON and OFF said switching means at another predetermined interval shorter than said predetermined interval when said outputted value approaches said comparison value, during said predetermined interval.

* * * * *